US007641706B1

(12) United States Patent
McMurry et al.

(10) Patent No.: US 7,641,706 B1
(45) Date of Patent: Jan. 5, 2010

(54) METHOD OF COMBUSTION

(76) Inventors: Zackery Allen McMurry, 6509 24th Ave. NE., Seattle, WA (US) 98115; James Casey Smoot, 6 Nathan Ct., Sacramento, CA (US) 95835

( * ) Notice: Subject to any disclaimer, the term of this patent is extended or adjusted under 35 U.S.C. 154(b) by 377 days.

(21) Appl. No.: 11/824,967

(22) Filed: Jul. 3, 2007

Related U.S. Application Data

(60) Provisional application No. 60/832,232, filed on Jul. 19, 2006.

(51) Int. Cl.
*C10L 1/00* (2006.01)
*C10L 1/18* (2006.01)

(52) U.S. Cl. ..... 44/307; 44/308; 44/385; 44/389

(58) Field of Classification Search ..... 44/301, 44/302, 307, 308, 311, 385, 386, 388, 389
See application file for complete search history.

(56) References Cited

U.S. PATENT DOCUMENTS 5,107,016 A * 4/1992 Pennetreau ..... 560/179
2005/0112735 A1* 5/2005 Zappi et al. ..... 435/134
2005/0239182 A1* 10/2005 Berzin ..... 435/166

OTHER PUBLICATIONS

Application of (R)-3-Hydroxyalkanoate Methyl Esters Dervied from Microbial Polyhydroxyalkanoate as Novel Biofuel; Biomacromolecules (2009) 10, 707-711.*

* cited by examiner

*Primary Examiner*—Cephia D Toomer
*Assistant Examiner*—Pamela Weiss
(74) *Attorney, Agent, or Firm*—Albert W. Davis, Jr.

(57) ABSTRACT

The present invention relates to the use of a naturally occurring group of biological compounds to produce a combustible fuel that may be used in either internal combustion engines or as a burnable heat source. These compounds are a set of biomolecules produced by some bacteria in nutrient limiting environmental conditions when storage of carbon is necessary. More specifically this invention envisions the use of polyhydroxy alkanoates (PHA), especially those ranging in size from C4 to C8, to produce the combustible fuel.

8 Claims, No Drawings

METHOD OF COMBUSTION

CROSS REFERENCE TO RELATED APPLICATIONS

This application is a continuation-in-part of provisional patent application Ser. No. 60/832,232 filed Jul. 19, 2006.

BACKGROUND OF THE INVENTION

This present invention relates generally to the field of alternative fuels and more particularly the conversion of cellular biomass to combustible liquid fuels. Currently much effort in the alternative fuel sector is directed at making ethanol production an economical alternative to standard gasoline and diesel fuels. Previous work done in this field has been related to the use of biomass to produce ethanol or mixtures of varying alcohol compounds. Some work has been done to derive ethanol from readily available sources such as municipal waste streams. There has also been advancement in the field of novel alternative fuels from renewable sources. This has been done in municipal waste systems where native cellulose has been isolated and then is further converted into varying lengths of hydrocarbons. However, this composition of products is highly variable and depends greatly upon the waste stream obtained from the municipal waste. Currently, Waste Water Treatment Plants (WWTPs) recover energy from influent waste streams by generating electricity and heat from by-products of the wastewater treatment processes by burning biogas. Biogas is a mixed gas byproduct (primarily methane and carbon dioxide) of anaerobic sludge digestion.

BRIEF DESCRIPTION OF THE INVENTION

The present invention relates to the use of a naturally occurring group of biological compounds to produce a combustible fuel that may be used in either internal combustion engines or as a burnable heat source. These compounds are a set of biomolecules produced by some bacteria in nutrient limiting environmental conditions when storage of carbon is possible. More specifically this invention envisions the use of PolyHydroxyl Alkanoates (PHAs) and their monomers, especially those ranging in size from C4 to C8 as a starting compound for production of a combustible liquid. A common source for these PHA compounds is bacteria found at many municipal waste water treatment plants (WWTP) in sludge (bio-solids) waste streams. During digestion of waste streams at these facilities bacteria are subject to low-nutrient/carbon-rich environments. Under these conditions bacteria are subject to a metabolic shift which prompts storage of carbon in the form of PHA compounds. The PHA compounds can be further processed using standard esterification and transesterification techniques with alcohols to produce a mixture of individual carbon compounds with longer carbon chains in the range of C6 to C12. Purification of the resultant volatile compounds can be done via distillation. The resulting mix of compounds is a highly flammable fluid that is a suitable fuel for applications such as automotive fuel or electricity generation.

The fuel, formed from PolyHydroxyl Alkanoate (PHA) compounds, described in this invention has chemical properties that suggest a much cleaner combustion than current fuels. The presence of oxygen in the compounds will lower the amount of particulates in the post-combustion exhaust gas as compared to most current automotive fuels. The heat of combustion using this fuel will also be lower than most current fuels, thus creating lower NOx levels when compared to most current combustible fuels. This fuel also can be derived from many large scale renewable sources. An obvious source of PHA compounds can be found in biomass streams, such as waste streams from municipal primary and secondary fermentation treatments. In these exit streams, concentrations up to 4 g PHA per 100 g wet bio-solid slurry have been seen. PHAs may also be produced more directly through standard fermentation processes. In these situations a feed stock of distiller's grains or agricultural waste may be used. Both of these carbon sources will form PHAs by introduction of proper organisms, efficient operating conditions, and non-carbon limiting nutrient conditions.

DETAILED DESCRIPTION OF THE INVENTION

The suggested method for treatment of streams containing PHAs to produce the combustible fuel of this invention is described below.

The aqueous, biomass stream containing the bio-solids must first be dehydrated to increase the yield of usable products as much as possible. The presence of water inhibits the production of the final combustible fuel. In order to remove water content to below 5% of the total weight a multistep dehydration process must be employed. Initially the sludge stream can be introduced to a centrifuge where biological solids can be separated from water. This will produce a wet semi-solid slurry of sludge with water content in the range of 75-85%. Next the solids will be further dehydrated using thermal processing methods. This can be done by introducing the wet slurry into a continuous flow heated barrel auger. This device works much like a continuous flow oven and is already used in industry. The residence time and temperature necessary can be adjusted to allow for an exit stream that is less than 5% water content.

After dehydration of the PHA slurry the bio-solids are resuspended in acidic or caustic solutions. The acidic and basic solutions cause the PHA granules to depolymerize, allowing them to be more accessible to the next chemical treatment step (transesterification). Ethanol is added in a 6:1 molar ratio of ethanol to PHA monomer units. Acid or base is then added to target a concentration between 0.5-2.0 normality with 2.0 normality being the preferred concentration.

Next the slurry may be heated to accelerate the esterification and/or transesterification. This slurry is mixed while temperature is held constant as the reaction proceeds.

The final stage is purification of the volatile fuel. This can be done numerous ways including chemical extraction, fractionation, or distillation. By using a distillation system, it is possible to create purities of product in excess of 90%.

It is contemplated that the alcohols that may be used for esterification and transesterification include the following: methanol, ethanol, propanol, butanol, pentanol, hexanol and others. There are also many PHAs that may be used including: polyhydroxyl propanoate, polyhydroxyl butyrate, polyhydroxyl pentanoate, polyhydroxyl hexanoate, polyhydroxyl heptanoate, polyhydroxyl octanoate and others. Moreover, it is fully recognized that varying mixtures of PHAs are common and subsequently a mixture of fuel compounds produced from PHAs with a mixture of monomers is typical.

Although the invention has been described in its preferred form with a certain degree of particularity, it is understood that the present disclosure of the preferred form has been made only by way of example and that numerous changes in the details of the method may be resorted to without departing from the spirit and the scope of the invention as hereinafter claimed.

We claim:

1. A method of combustion, comprising the following steps, treating a bacterial biomass stream containing PHAs to produce a substantially dehydrated PHA stream, adding a basic solution to the dehydrated stream to re-suspend and depolymerize the PHA, adding an alcohol and heating the mixture to produce a transesterification reaction of the mixture, purifying the mixture to produce a fuel and combusting the fuel.

2. The method of claim 1, including the step of, obtaining PHA to produce the fuel from renewable sources.

3. A method of combustion, comprising the following steps, treating a bacterial biomass stream containing PHAs to produce a substantially dehydrated PHA stream, adding an acidic solution to the dehydrated stream to re-suspend and depolymerize the PHA, adding an alcohol and heating the mixture to produce a transesterification reaction of the mixture, purifying the mixture to produce a fuel and combusting the fuel.

4. The method of claim 3, including the step of, obtaining PHA to produce the fuel from renewable sources.

5. A method of combustion, comprising the following steps, treating a bacterial biomass stream containing PHAs to produce a substantially dehydrated PHA stream, adding a basic solution to the dehydrated stream to re-suspend and depolymerize the PHA, adding an alcohol and heating the mixture to produce a esterification reaction of the mixture, purifying the mixture to produce a fuel and combusting the fuel.

6. The method of claim 5, including the step of, obtaining PHA to produce the fuel from renewable sources.

7. A method of combustion, comprising the following steps, treating a bacterial biomass stream containing PHAs to produce a substantially dehydrated PHA stream, adding an acidic solution to the dehydrated stream to re-suspend and depolymerize the PHA, adding an alcohol and heating the mixture to produce a esterification reaction of the mixture, purifying the mixture to produce a fuel and combusting the fuel.

8. The method of claim 7, including the step of, obtaining PHA to produce the fuel from renewable sources.

* * * * *